US007758418B2

(12) United States Patent
Manz

(10) Patent No.: US 7,758,418 B2
(45) Date of Patent: Jul. 20, 2010

(54) SYSTEM AND METHOD FOR PRESENTING A GAME WIN AS AN INDEPENDENT EVENT

(75) Inventor: Robert Manz, Las Vegas, NV (US)

(73) Assignee: Rocket Gaming Systems, LLC, Grove, OK (US)

( * ) Notice: Subject to any disclaimer, the term of this patent is extended or adjusted under 35 U.S.C. 154(b) by 1067 days.

(21) Appl. No.: 10/924,731

(22) Filed: Aug. 23, 2004

(65) Prior Publication Data

US 2006/0040722 A1 Feb. 23, 2006

(51) Int. Cl.
*A63F 9/24* (2006.01)

(52) U.S. Cl. ..... 463/25

(58) Field of Classification Search ..... 463/16–20, 463/25

See application file for complete search history.

(56) References Cited

U.S. PATENT DOCUMENTS 5,014,991 A 5/1991 Mirando et al.
5,129,652 A 7/1992 Wilkinson
5,265,874 A * 11/1993 Dickinson et al. ..... 463/25
5,417,424 A * 5/1995 Snowden et al. ..... 463/18
5,569,082 A * 10/1996 Kaye ..... 463/17
5,709,603 A * 1/1998 Kaye ..... 463/17
5,749,784 A 5/1998 Clapper, Jr.
5,816,918 A * 10/1998 Kelly et al. ..... 463/16
5,909,875 A 6/1999 Weingardt
6,048,269 A * 4/2000 Burns et al. ..... 463/25
6,089,982 A * 7/2000 Holch et al. ..... 463/42
6,210,275 B1 4/2001 Olsen
6,210,276 B1 4/2001 Mullins
6,251,017 B1 * 6/2001 Leason et al. ..... 463/42
6,364,765 B1 * 4/2002 Walker et al. ..... 463/16
6,500,067 B1 * 12/2002 Luciano et al. ..... 463/25
6,578,735 B1 * 6/2003 Mothwurf ..... 221/255
6,623,357 B2 9/2003 Chowdhury
7,016,861 B2 * 3/2006 Mothwurf ..... 705/14
2002/0058548 A1 5/2002 Stronach
2003/0013515 A1 1/2003 Rowe et al.
2003/0087691 A1 5/2003 Kiely et al.
2003/0153381 A1 * 8/2003 Slattery ..... 463/16
2003/0186734 A1 10/2003 LeMay et al.
2005/0033642 A1 * 2/2005 Mothwurf ..... 705/14

* cited by examiner

*Primary Examiner*—Scott Jones
(74) *Attorney, Agent, or Firm*—Weide & Miller, Ltd.

(57) ABSTRACT

Embodiments of the invention relate to gaming machines, and more particularly, to a system and method for presenting a game result as an independent event. Systems embodying one or more aspects of the invention enhance the game playing experience by presenting players with a receipt or media that gives players the opportunity to obtain sensory feedback subsequent to playing a first game. This sensory feedback, which is based on information encoded on the receipt and possibly stored on a server for later cross checking, is provided via a winning display machine and may take multiple forms. The winning display machine may, for instance, read the information on the receipt and simply inform the user of the amount or result of the first game. Alternatively or in addition the winning display machine may utilize the information encoded on the receipt to simulate the appearance of additional game play.

20 Claims, 3 Drawing Sheets

RECEIPT
200

SYSTEM AND METHOD FOR PRESENTING A GAME WIN AS AN INDEPENDENT EVENT

FIELD OF THE INVENTION

Embodiments of the invention relate to gaming machines, and more particularly, to a system and method for presenting or displaying a game result as a secondary event.

BACKGROUND OF THE INVENTION

Many of today's gaming machines utilize a self-contained mechanism to provide instantaneous sensory feedback to users about the game result. For instance, once a game is played players are immediately presented with a combination of visual display elements representative of the game result. A certain combination of visual display elements may represent a win (e.g., 7-7-7) whereas other combinations of display elements inform the player of a loss. These display elements are generated and displayed upon the same machine. This approach of instantaneously displaying a game result is common among many different types of games (e.g., video slots, video poker, video keno, video bingo or other games) and is well-known to one of ordinary skill in the art.

By providing regular and immediate sensory feedback such existing game machines are able to generate a feeling of excitement among players and thereby keep players engaged in game play at a particular machine for a longer period of time than would otherwise be the case. In gaming environments where multiple game machines are in close proximity to one another (e.g., a casino), this sensory feedback also serves to keep an air of excitement among observers and other players. When a favorable game result is achieved the resulting set of audible and visible display elements announcing the win may attract a crowd and lead to further game play by one of the observers or the player. The greater the amount of game play the more profitable each gaming machine becomes. Hence, such systems for providing relatively immediate sensory feedback are widely utilized in the gaming industry.

A disadvantage of using systems that provide instantaneous sensory feedback is that such systems do not generate a sense of accumulated anticipation as to the game result. Upon conclusion of each game session players are informed of the result from the game play thereby leaving no sense of anticipation about the outcome of the game. As a result there is a need for a system capable of enhancing a player's overall anticipation about their game play.

SUMMARY OF THE INVENTION

Embodiments of the invention relate to gaming machines, and more particularly, to a system and method for presenting or displaying a game result as a separate or independent event.

The system is configured to enable a player to play a first game (including games such as slots, poker, blackjack, keno, bingo, pull-tabs and lotteries, whether such games are presented at electronically-controlled, mechanical or electromechanical gaming machines, at tables and using cards or other equipment/devices). In a preferred embodiment, if the player obtains a winning result, then information regarding the winning result is associated with a media. In one embodiment, the media is a printed receipt or ticket that is encoded with the winning result or information which identifies winning result information stored elsewhere.

The player utilizes that media to generate the winning result. In one embodiment, the player takes the media, such as the receipt, to a second machine—referred to herein as the winning display machine. The encoded receipt or other media is read by the winning display machine which then executes a sensory feedback event to convey the winning result. Preferably, winnings such as a complementary prize, monies or credits are provided to the player for the winning result.

In one or more embodiments, the sensory feedback events include simulated games or various other displays designed to generate interest and add excitement to the gaming experience. The sensory feedback event may simply be a display of the winning amount, display of a combination of symbols corresponding to a winning amount, or a simulated game.

Systems embodying the invention have particular applicability to Class II games. The player may play, for example, a game of bingo on a video type machine. If the player gets a particular winning combination or combinations, then a receipt representing the winning result is printed. The player uses the receipt to obtain their winnings at the winning display machine. The winning receipt could be used to display a combination of slot symbols on the winning machine, such as 7-7-7, which corresponds to the winning amount. Hence, the winning display machine can simulate game play based on the winning game result initially obtained at the first game machine. In this manner, players of a Class II game are able to also obtain the experience of playing a simulated Class III game without actually playing the Class III game.

In one or more embodiments, the game played on the first game machine and the game simulated by the sensory feedback event on the winning display machine may be the same or a different game type and in the same or different game classification (e.g. Class II, III).

In one or more instances the receipt or other media contains data or other information used for authentication purposes. A network or other interconnection fabric may optionally provide a transport mechanism for exchanging authentication or other data between the first game machine and winning display machine, but such transport mechanisms are not necessarily required by all embodiments of the invention. When the system utilizes a network to authenticate, the information coded on the receipt or information corresponding to the receipt can be stored on a gaming server, player tracking server or on one or more of the game machines or winning display machines. Indicia or other cryptographic techniques encoded onto the receipt can also provide a basis for authentication such as, but not limited to, bar codes, magnetic strips or printed numbers.

The winning result receipt may take the form of a tangible item such as a printed ticket or simply reside as data expressed in a memory medium such as a computer or smart card. In either form the winning result receipt is or represents a "winning result" from the player's playing one or more of the first game machines.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention relate to gaming machines, and more particularly, to a system and method for presenting or displaying a game result as a separate or independent event. Systems embodying one or more aspects of the invention enhance the game playing experience by presenting or displaying a game result separate from winning play of a game.

In one embodiment, a player who obtains a winning result while playing a game is provided with a receipt or other media. The player uses that receipt or media to initiate a secondary event which provides the game result. Preferably, the secondary event provides the player with sensory feedback regarding the game result. This sensory feedback, which is based on information encoded on the receipt and preferably verified, such as by cross-checking against information stored on a server, is provided via a winning display machine and may take multiple forms.

In the preferred embodiment, the winning display machine is separate from the machine which the player uses to play the main game. The winning display machine may, for instance, read the information on the receipt and simply inform the user of a winning amount or result of the first game. Alternatively, or in addition, the winning display machine may utilize the information encoded on the receipt to simulate the appearance of additional game play.

Figure 1:
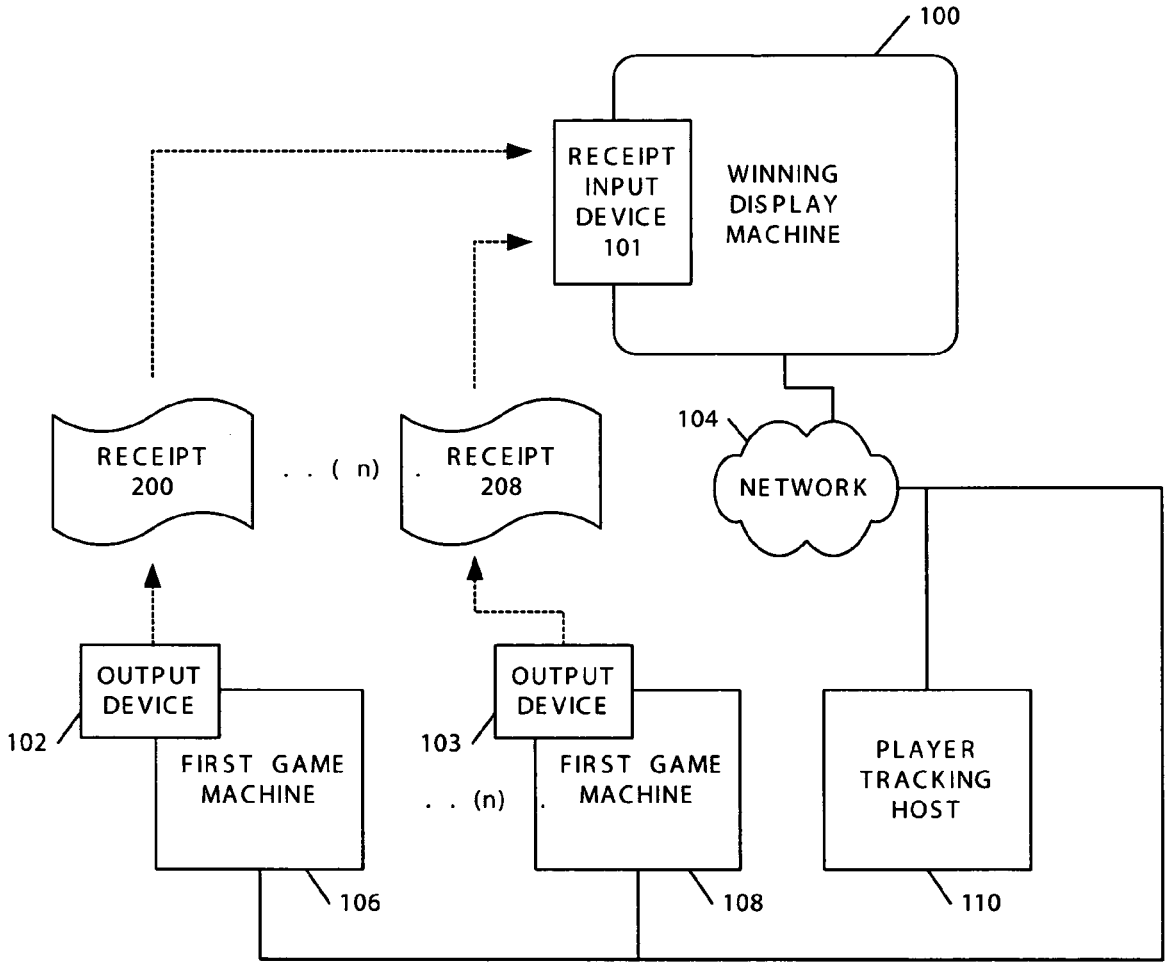
FIG. 1 is a system diagram showing the various components used to implement the game in accordance with an embodiment of the invention.

FIG. 1 illustrates one set of system components used to provide the game play experience contemplated by one or more embodiments of the invention. In the example illustrated, the system includes a first game machine 106 configured to execute one or more iterations of any game, a receipt output mechanism 102 (which is optionally part of the first game machine), and a winning display machine 100 configured to provided sensory feedback based on a receipt 200 generated by the receipt output mechanism 102. The various elements of the system can be interconnected via a network 104 and the system may also include a server such as, but not limited to, a player tracking host 110 capable of tracking the play and game results of players. The system is scalable in that it may contain any number of winning display machines 100, receipt input devices 101, first game machines 106-108, receipt output mechanisms 102 and 103, player tracking hosts 110, or networks 104.

The first game machines 106 and 108 may include, but are not limited to, a set of components configured to output a game result based on one or more of the following games: slots, poker, keno, bingo, blackjack, lotteries, pull-tabs, dice or other events. Those components may comprise, for example, an electronically-controlled gaming machine (such as a video slot, poker or bingo machine), a mechanical or electro-mechanical gaming machine (such as a reel-type slot machine), table games (such as craps, blackjack and the like), and other equipment or devices, such as bingo cards and associated equipment, pull-tabs, lottery tickets and others. Although the first game machine is not explicitly limited to such, the first game machine is typically able to derive the game result based upon input provided by the player at the game machine itself.

In instances where player input into the first game machine is not practical (e.g., table games) the first game machine may represent a simple conduit of the game result. For instance, a dealer or any other authorized individual may provide players with the enhanced game play experience or secondary event by inputting a game result into the first game machine or any machine associated with the first game machine through its connectivity to the first game machine (e.g., the receipt output mechanism 102).

Since the first game machine is but one component of the system it may represent a series of components or machines that ultimately make up the first machine or a single stand alone machine. Thus, the first game machine can be any number of interconnected machines where each machine is played by one or more players or a set of stand alone machines. When the machines are connected they are typically done so by using a network 104 or any communication transport that enables one machine to transfer data to/from another machine.

As indicated above, the first game machine 106 may have a variety of configurations and features (and the invention is not limited to an embodiment where a first game is presented by a "first machine" per se, but includes game events presented with tickets, at tables using cards, dice and/or other equipment, and a wide range of other events). For example, the first game machine 106 may be an electro-mechanical machine including rotatable display reels, or be a video machine including one or more displays. The first game machine 106 may include player input means, such as "hold" buttons, a "spin" arm or button and other devices. The first game machine 106 may include an internal controller (such as a CPU, a random number generator and a memory) for presenting a game and generating game results. Various of such components might also be located remotely, such as at a server, with the first game machine 106 substantially comprising a display terminal.

Referring still to FIG. 1, each one of the set of first game machines 106-108 has an associated output mechanism 102-103 respectively for generating any number of receipts (200-208). The receipt output mechanism 102 may generate receipts of different types or for different purposes in a variety of different forms. In at least one embodiment of the invention the receipt output mechanism 102 is configured to obtain one or more game results from the first game machine 106 and print a receipt 200 including information that represents or identifies the game result(s) and possibly other information encoded onto the receipt. Receipts 200-208 may take the form of and thereby encode information via a tangible media or medium (e.g., paper, plastic, or any other medium) and/or a memory medium (e.g., computer memory, smartcards, etc. . . . ). The various elements of these receipts are described in further detail below with reference to FIG. 2. Further, as described below, instead of "printing" the information, the output mechanism 102 may encode or otherwise associate information with the media or medium. For example, in the case of a magnetic stripe containing card, the information may be encoded onto the stripe.

In such embodiments, the output mechanism 102 may be a receipt printer configured to print information upon individual paper receipts or a roll of such receipts or the like. The output mechanism 102 could also comprise a magnetic stripe writer or other electronic, magnetic or optical writer.

As also detailed below, the particular information which is associated with the receipt 200 or other media may vary. In one embodiment, the information represents a winning outcome or result. The information may itself identify that result, or may identify a file or other information located remote from the receipt 200 regarding the result.

The winning display machine 100 is configured to read information encoded onto receipts 200-208 via an associated receipt input device 101. The input device 101 may vary depending upon the media utilized. For example, the input device 101 may comprise an optical reader, such as a bar code reader, or may comprise a magnetic stripe reader.

In the preferred embodiment, the winning display machine is configured to output sensory feedback, in the form of a game result, to an interface where it is presented to the player. This sensory feedback may take the form of visual, auditory and/or other forms of output and may simply comprise the display of a winning amount, a combination of symbols corresponding to a winning amount, or a simulated game. That output is generated in response to the input of the media.

In one or more embodiments of the invention the sensory feedback announces one or more game results obtained by the player as a function of game play at one or more of the first game machines. Sensory feedback presented via the winning game machine may include, but is not limited to, simulated game play. Such simulated game play may include any variety of different games and can be configured to convey the feeling of excitement and anticipation associated with play of the first game. The simulated game can be the same game as the first game or a different game. The first game machine(s) may, for instance, present one or more Class II games and the winning game machine(s) may simulate or present a Class III game. Alternatively, or in addition, the inverse may also be the case. Thus, games played on the first game machine and the game or winning result presented or simulated by the sensory feedback event on the winning display machine may be the same or a different game type and in the same or different game classification (e.g. Class II, III, etc. . . . ).

The game played or presented on the winning results machine may optionally provide a better result than was garnered from a single first game experience. For example, the receipt may be an accumulated receipt which combines the results of multiple first game results. For example, a first game receipt combining the winnings from 25 bingo wins may show up on the winning display machine as a Poker straight flush resulting in a large payout, whereas a receipt with 1 bingo first game win may display as three-of-a-kind resulting in a small payout.

Systems embodying the invention have particular applicability to Class II games, but are applicable to games of any class. The player could play, for example, a game of bingo on a video type machine. If the player gets a particular winning combination or combinations, then the receipt is printed. The player uses the receipt to determine and/or obtain their winnings at the winning display machine. The winning receipt could be used to display a combination of slot symbols on the winning machine, such as 7-7-7, which corresponds to the winning amount. The 7-7-7 could result on a graphics display with the three drums rotating and finally stopping at 7-7-7, for example. Hence, the winning display machine can simulate game play based on the game initially played at the first game machine. Thus, players who interact with a Class II game are able to also obtain the experience of playing a simulated Class III game without actually playing the Class III game.

Figure 2:
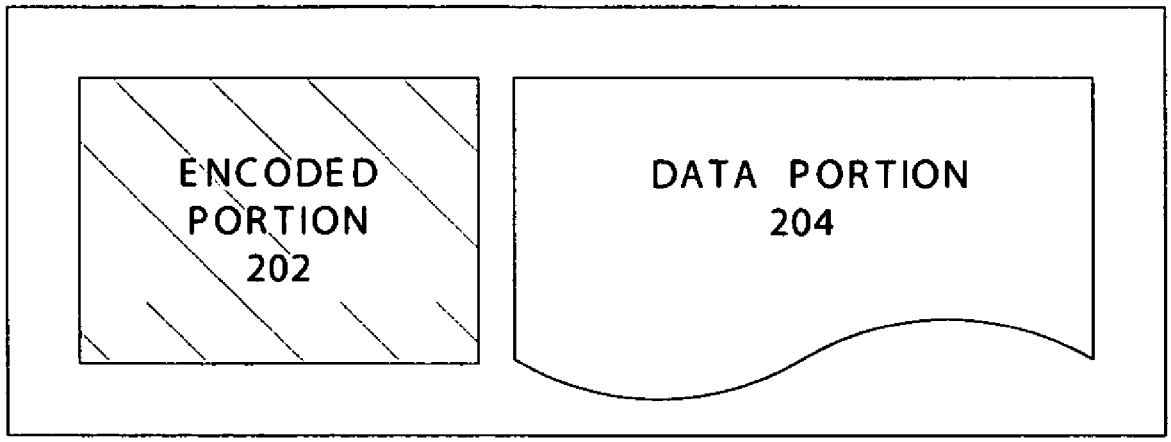
FIG. 2 illustrates a receipt in accordance with an embodiment of the invention.

Referring to FIG. 2, there is illustrated one embodiment of a receipt 200 (also known as winning result ticket or a complimentary prize ticket) generated by the output mechanism which is representative of one or more game results. In one or more embodiments of the invention the information associated with the receipt 200 includes machine readable information (e.g., encoded portion 202). For instance, when receipt 200 is printed onto the tangible medium the game result it is typically contained in an encoding scheme that cannot be deciphered from a casual glance, but is capable of authentication. A UPC type bar-code or encrypted indicia are examples of machine readable information contained in encoded portion 202.

The encoded portion 202 may represent encoded information such as the value of the receipt 200 or other information such as the game result obtained at one or more of the first game machines. Encoded portion 202 may also contain a validation code or identifier used to authenticate the receipt. Information such as the value of the receipt 200 is obtainable utilizing the validation code or number. This information capable of being located or stored remote from the receipt. In one or more embodiments of the invention this information may be authenticated by communication between the winning display machine and other nodes on network 104 (e.g., the first game machine), such as a gaming server or player tracking host 110.

On data portion 204, the receipt 200 may also include other information, such as a date of issuance or descriptive portions of text such as advertisements or other promotions. This information may be readable by the player. In one or more embodiments of the invention a date-time stamp and machine number along with the winning result is stored not only on the receipt in encrypted format, but also on player tracking host 110. When the receipt is read on receipt input device 101, the date-time stamp and machine number can be cross checked in order to verify that indeed the receipt corresponds to a previously played game so that even if the encryption is broken, the receipt will not result in a payout if there is no game result saved at the date-time stamp on the machine in question.

As was noted above and briefly described, the receipt 200 may have a variety of forms. For example, bar coding may be printed directly on a paper or accomplished with different colors of material comprising the receipt 200, such as by exposing thermoplastic to high heat or the like to generate the spaced bars. The magnetic stripes, chips or other information storage elements may be associated with the receipt 200 for use in storing the information. Information may be coded in the form of punch holes or other patterns of material or voids of material.

The information which is associated with the media, such as printed on the receipt 200, may vary. Preferably, the information is useful in causing the winning results machine to display a winning result event. The information may comprise, for example, information identifying the particular game played by the player and the outcome. The information may simply identify a result which the winning result machine should generate. The information may comprise a win value. As also indicated, the information may also simply identify other information, or the location or identity of other information, which is useful in causing the winning results machine to display the winning results event.

By way of example, a player may play a game of video bingo on the first gaming machine and receive a particular combination which is a winning combination. The information which is associated with the media may identify that particular winning combination. The information might alternatively or additional simply identify the "value" of the win (such as a "40 credit" win) or a completely different result which the winning results machine should display. For example, if the winning results machine is configured to present outcomes as the result of a "spin" of reels, then the "value" information may cause the winning results machine to cause the reels to stop at a winning combination equivalent to the value of the win, which win is then dispensed to the player. As indicated, the information could also specifically identify the particular winning result to be displayed, such as 7-7-7 on the reels. The winning results machine could also utilize a look-up table to compare the result or results to be displayed when the particular winning combination of the first game is identified. For example, a particular winning bingo pattern may be mapped to the outcome 7-7-7 to be displayed by the winning results machine.

In a preferred embodiment, the winning results machine displays a result which specifically corresponds to the game outcome(s) from first game play. In other words, within the system, once the first game(s) are played, the game results to be displayed at the winning results machine are known. In other embodiments, however, the winning results machine could display randomly generated results. For example, a winning result may be randomly selected from a set of possible winning results.

In accordance with the invention, the winning result is preferably not identified to the player at the first gaming machine, or else at least any monetary award or prize associated with that result is not identified or awarded at the first gaming machine. Preferably, the player must travel to and utilize the winning results machine to identify the winning result and/or collect their winnings.

In one embodiment, the player may be provided information that a winning result was obtained while playing the first gaming machine. For example, the player may learn such simply because a receipt is printed for use by the player at the winning results machine. The fact that a particular result is a winning result may also be posted. For example, all winning bingo patterns may be identified to the player of the first gaming machine. Preferably, however, the actual winning result, primarily associated with a particular winning payout, is not known or presented to the player at the first gaming machine.

In one embodiment, a receipt or other media may be issued to a player in all instances, requiring that the player travel to the winning results machine to determine if the results of the play at the first gaming machine were winning or losing. For example, while receipts are preferably only issued for winning results, receipts may be issued for all results. In yet another embodiment, certain game results are provided to the player at the first game machine, while other are not. For example, small wins may be identified and awarded at the first game machine. Large wins, bonus wins and the like may not be awarded at the first game machine but instead be presented at the winning results machine.

As indicated, information regarding a plurality of game results may be associated with a single media. For example, a player may have the option of playing a number of games at the first gaming machine. At the conclusion of play, the player may indicate such, at which time the media is issue to the player. The player may then utilize that media at the winning results machine to obtain the results of the various games. The player could also simply collect a plurality of receipts. In either of these two situations, a player may be presented with a plurality of winning results at the winning results machine at the same time.

The media described may have additional properties or characteristics. For example, printed receipts may have other information associated therewith. If the media is a magnetic striped card, the media may comprise a player tracking card and have player identity or player tracking information also associated therewith. The media might also comprise a coded room key which includes room access information.

As indicated, the media is preferably used by the winning results machine to present the result of a game. In one embodiment, the media may be used for other purposes as well. For example, based upon player play, a complimentary award or "comp" may be issued to the player. Such are well known in the art. The media may be used to identify the award of the "comp" and issue that award, whether at the winning results machine or elsewhere.

Figure 3:
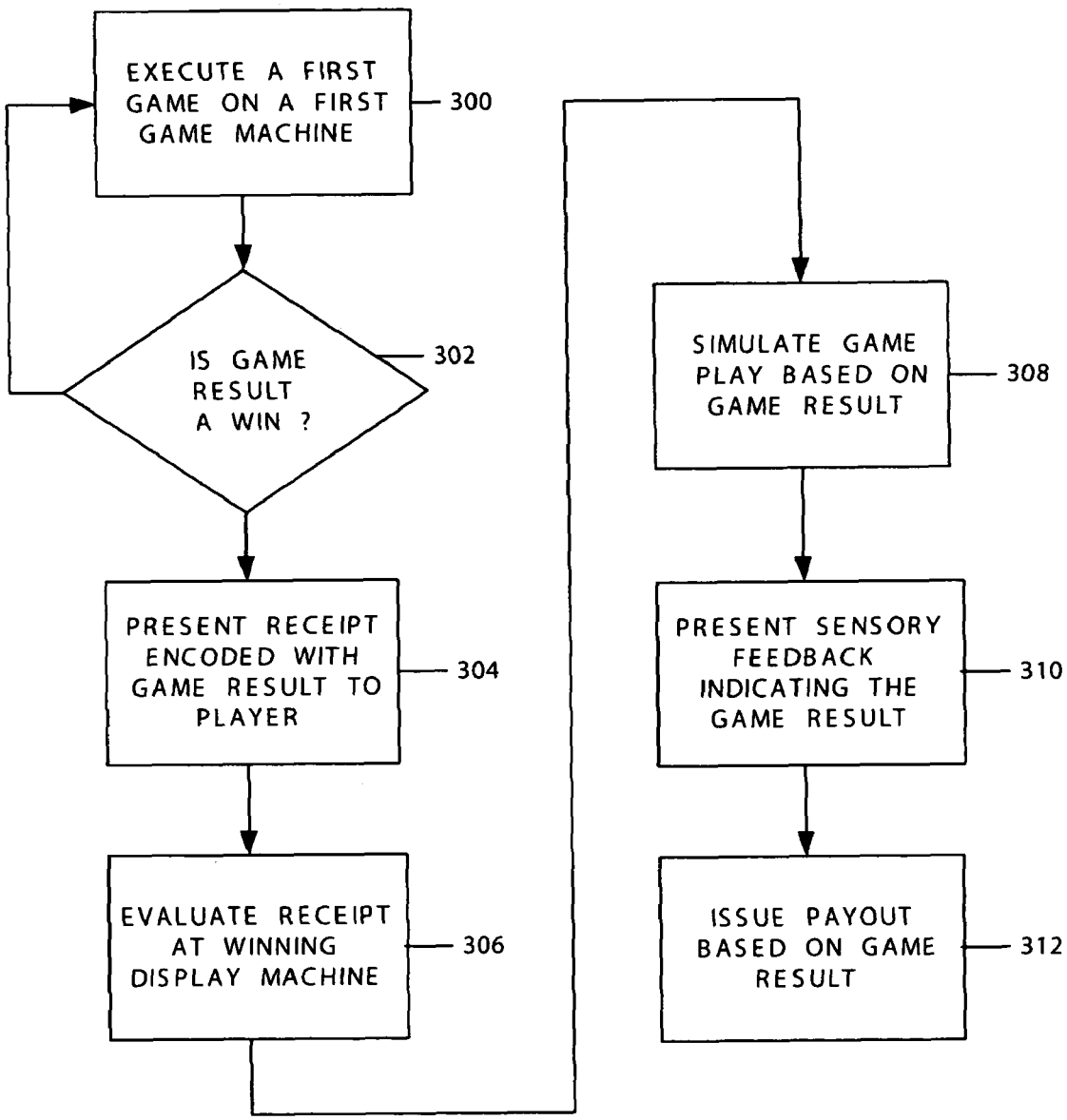
FIG. 3 is a flow chart illustrating the process for obtaining a receipt and presenting a game result in accordance with an embodiment of the invention.

Referring now to FIG. 3, a flow chart of one embodiment of a method or process in accordance with an embodiment of the invention is shown. In a step 300, a player plays one or more games at a first gaming machine. Players may play any kind of game at the first game machine, and the first game may be of any classification such as, but not limited to, Class II and Class III games. The game may include a player participation or a "skill" element (such as video poker) or may not (such as in the case of video or mechanical slots). Preferably, the outcome of each game is a result.

If the result of the game play is a loss at step 302, the player may play the game (or a different game) again at step 300. In one or more embodiments of the invention a receipt or ticket may be printed in the event of a losing result, as described herein. In one embodiment, such a receipt may be printed with information identifying a complementary prize, such as if the player has lost an amount over a threshold, if the player has randomly been selected to win a complementary prize, or under conditions where multiple first game machines are randomly selected at a certain time to present complimentary prizes at the same time, thereby generating more player interest and loyalty in an establishment comprises embodiments of the invention.

If the result of the game play is a win, then the player is preferably presented with or issued a receipt (e.g., winning ticket) at step 304. The receipt may include advertisements or be shaped in such a way as to show that the person is a winner. The receipt may also contain puzzles with scratch off sections that a winning game machine may read to determine if a player has won a bonus prize. Alternatively, the player may choose to print a summary receipt once game play is complete with the winning results for all games played by the play on the machine.

If a player has presented a hotel room key, player tracking card or the like to the first game as a form of identification, then the game result information can be stored on the key or card or a remote server. When the player uses the hotel room key or player card to identify themselves to the winning display machine the second game result may be displayed. The hotel room key in this example would not require data storage capabilities although the key could be used in embodiments of the invention in order to store the first game results as well or in combination with the information stored on the server. The storage of the data in two places may ensure that the receipt is authentic in that the server and the receipt would both have to be defeated in order to forge a win.

As indicated, information associated with the receipt, ticket or other media may be the result information, or may simply identify result information located or stored elsewhere, such as on a server or any combination of the forementioned storage locations. When the game result information is stored on a server, such as a player tracking server or game server, it may be stored with a date-time stamp and other identifying information such as a machine serial number so that any receipt or ticket presented to a winning display machine in step 306 may be cross checked and verified to be authentic. The printed receipt may also include other information that is human readable, such as a date of issuance, expiration date or descriptive portions of text such as advertisements or other promotions.

In the server configuration, information regarding pertinent game results may be stored at the server, or a device in communication with the server. Where the first game machine presents and generates the game, the result information may be transmitted to the server for storage. When the media is presented to the winning results machine, that machine may signal the server to access the corresponding game result information. In one embodiment, game result information may then be forwarded to the winning results machine for use by the machine. In another embodiment, the server uses the information to generate information which is transmitted to and used by the winning results machine. In yet another embodiment, the necessary information to generate the result is associated with the ticket, and the information at the server is used to validate the media or result, i.e., to establish that the winning results machine should present and pay winnings (that the media was not forged, tampered, stolen or the like).

In embodiments of the invention that print the receipt onto a tangible medium that is presented to the player in step 304, the game result is typically encoded or encrypted in such a way that it cannot be visibly deciphered. It is the task of the winning display machine to decipher the receipt either with or without date-time stamp information and/or machine identification or serial number at step 306. In embodiments of the invention that utilize network connections between first game machines and winning display machines an extra level of security is obtained by date-time stamping the receipt and saving this on the server. This provides the system with an auditing capability that allows for diagnostics to discern if a particular machine is not properly working if there is a drop-off in the number of wins that are generated from a particular machine. This information may also be used in order to adjust the topology of the playing machines in order to maximize the amount of players playing the machines. This can be performed by running tests in certain configurations, analyzing the playing results, adjusting the locations and orientations of the first game machines and winning display machines in order to maximize profits. Step 306 may also comprise a security feature that makes game play on the winning display machine prolong until security personnel can surround a player that has attempted to forge a receipt or alternatively may automatically dial via telephone security forces such as the police.

The encryption utilized in the system may be one way encryption where a receipt ID is used to encrypt the human readable information displayed on the card into a series of numbers or bar code stripes. The winning display machine may then take the human readable information and perform the one way encryption on its local processor and if the result is the same as the series of numbers or bar code stripes on the receipt, then the receipt is assumed valid. Alternatively, all relevant human readable information on the card may be encrypted including the winning result and possibly a date-time stamp and first game machine identification with multiple encryption using different algorithms in order to make the forgery of such a receipt increasingly difficult. Generally, the more security measures employed, the more difficult to forge.

The system may also deploy biometrics that allow for identification of the receipt holder as being the player that actually played the first game. Biometric devices such as finger print readers or retinal scanners could be used in place of electronic devices such as a smart card or hotel room key in order to save the results of first game play on a server and associate those results with a player who has identified himself to the first game machine. This would render the carrying of cards and receipts altogether although the player would still visit a winning display machine after playing a first game machine in order to collect the payout whether cash or prize in nature.

In a preferred embodiment, printed receipts are stored at the input device once used, preventing their use by a player again. The stored receipts may be collected for later accounting.

In the case of an electronic media, the electronic data is preferably updated to reflect use of the data to collect the results/wins.

At step 308, the secondary event is initiated. Preferably, this comprises the step of the winning display machine simulating a game to the player. The simulation may take the form of a multimedia or graphical simulation of a game, for example, the simulation may actually show a 3-D rendering of slot wheels turning, clicking, slowing down and finally stopping at the predetermined winning result based on the win from the first game. This may occur with sound sampled from the game being simulated in order to further simulate the second game playing experience.

Examples of simulated game play may include a 3-D graphics game of for example a dealer dealing cards to a player or any other simulated game rendering. The simulated game can be the same game as the first game or a different game. The first game machine(s) may, for instance, represent a set of Class II games and the winning game machine(s) may simulate Class III games. Alternatively, or in addition, the inverse may also be the case. Thus, games played on the first game machine and the game simulated by the sensory feedback event on the winning display machine may be the same or a different game type and in the same or different game classification (e.g. Class II, III, etc. . . . ).

As described above, the game results may be presented in various fashions, including simply displaying win or loss information, dispersing winning amounts or the like, in addition to or apart from presentation of a second game-type event.

At step 310 the sensory feedback announces one or more game results obtained by the player as a function of game play at one or more of the first game machines. Sensory feedback presented via the winning game machine may include clapping and cheering, flashing lights, buzzing sounds or any other stimulating sensory feedback. Step 310 may include in addition to sound and graphical simulation, other sensory feedback such as shaking a platform or infrared flashers which may be utilized to provide a sense of heat or feeling for certain reward levels to further increase the sensory feedback associated with a winning result or prize.

A payout may be issued at step 312 if the payout is monetarily based. Alternatively, show receipts, dinner vouchers or other prizes may be printed or released from the winning display machine, or credits may be awarded. In some embodiments of the invention, the winning display machine may allow the user to insert their hotel door key that may include a magnetic strip or smart card processor capable of storing the payout electronically so that the user may apply the winnings to the player's hotel bill. Alternatively, the winnings may be credited to a credit card, a player's smart card or hotel room account via a hotel room key used as an identifier for a server or as previously mentioned, via the data storage capabilities of a hotel room key in embodiments of the invention utilizing hotel room keys with sufficient data storage capabilities.

The invention has a number of advantages. A primary advantage of the invention is that it adds excitement to a player's gaming experience. In particular, a player not only receives the excitement of playing a game, but is provided the added excitement of a secondary event providing the results of that game. In the case of winning results, a player may know that they are already a winner, such as by issuance of the receipt. However, anticipation builds because the player does not know what the actual win is, such as in terms of the winning payout.

The player can contribute to the anticipation by collecting receipts and then cashing them in at the end of a period of play. For example, a player may obtain twenty (20) receipts during a period of play. The player may then take those receipts to the winning results machine and be presented with twenty consecutive winning results.

Preferably, only once the results have been obtained via the winning results machine are any winnings available to the player. Thereafter, the player may be paid monies or provided with credits for a variety of purposes, including other game play.

An additional aspect of the invention is that there may be only one or a few winning results machines for a greater number of first gaming machines. All players of the first gaming machines must then utilize those winning results machines to obtain their results. In this manner, players may congregate at the winning results machine and be exposed to a great number of winnings, including not only theirs but those of third parties, adding to the excitement of the gaming experience.

As indicated above, in a preferred embodiment, the first game is presented at a first gaming machine and the winning results are presented via a second gaming machine. As also indicated, however the first game may be presented at other than a gaming machine per se, such as using tickets, pull-tabs and at tables using cards, dice and/or other equipment. In such event, the ticket or other media may be generated in a variety of fashions. For example, at a table game, the dealer might provide an input to a ticket generating device or issue the player a "winning" ticket from a stack of pre-printed winning tickets. In the case of pull-tabs or lotteries, the pull-tab or lottery tickets might be input into a machine which reads those tickets and then generates and outputs the "winning" ticket or media, or the pull-tab or lottery ticket may be presented to game personnel who accepts the ticket and then distributes a "winning" results ticket for use in presenting the second event.

As also indicated, in a preferred embodiment, the results ticket is used by a second gaming machine to present the outcome of the event. In other embodiments, however, the outcome might be presented in other manners. For example, the "results" ticket or media might comprise a pull-tab, scratch-off or other ticket where the results may be obtained from the ticket itself.

Thus, a gaming system has been described. It will be understood that the above described arrangements of apparatus and the method thereof are merely illustrative of applications of the principles of this invention and many other embodiments and modifications may be made without departing from the spirit and scope of the invention as defined in the claims.

What is claimed is:

1. A method of playing a game comprising:

presenting a first game at a first gaming machine including displaying game information regarding said first game at said first gaming machine;

determining a result of said first game;

in the event said result of said first game is a losing outcome:

displaying information identifying said outcome of said game as a losing outcome to said player at said first gaming machine; and in the event said result of said first game is one or more winning outcomes:

associating information regarding said result with a media without displaying said result of said first game at said first gaming machine;

accepting said media at a winning display machine different than said first gaming machine;

obtaining said information regarding said result of said first game presented at said first gaming machine from said media at said a winning display machine; and utilizing said information regarding said result to display information regarding said result to a player in the form of sensory feedback presented at said winning display machine.

2. The method of claim 1 wherein said step of displaying said result at said winning display machine comprises simulating the presentation of a second game event.

3. The method of claim 2 wherein said first game and said second game event are of a different game type.

4. The method of claim 2 wherein said first game and said second game event are of a same game class.

5. The method of claim 2 wherein said first game and said second game event are of a differing game class.

6. The method of claim 1 further comprising determining the authenticity of said information associated with said media.

7. The method of claim 6 wherein data to perform said determining said authenticity of said information associated with said media is associated with said media.

8. The method of claim 1 wherein said step of associating said information with said media at said first game machine comprises printing information upon a receipt.

9. The method of claim 1 wherein said step of associating information regarding said result with a media without displaying said result of said first game at said first gaming machine comprises displaying a visible display of a game outcome but not displaying information regarding a value of an award associated therewith.

10. The method of claim 9 wherein said step of utilizing said information regarding said result to display information regarding said result to a player in the form of sensory feedback presented at said winning display machine comprises displaying information regarding a value of an award associated with said result.

11. The method of claim 1 including storing information regarding said result in a memory accessible by said winning display machine, wherein said information associated with said media identifies said stored information and wherein said step of obtaining said information regarding said result from said media at a winning display machine comprises reading said information associated with said media and utilizing said information to access said stored information, and wherein said stored information is used by said winning display machine to displaying said information regarding said result to a player.

12. A system for simulating game play based on a game result comprising:

a first game machine configured to present a first game having a result, wherein said first game machine is configured to display said game result if said result is a losing outcome and to not display said result if said result is one or more winning outcomes;

a media generated by said first game machine in the event said result is one of said one or more winning outcomes, said media having information regarding said result associated therewith, said information associated with said media by a device associated with said first game machine; and a winning display machine configured to read said information associated with said media and present winning outcome game result information to a player in the form of sensory feedback.

13. The system of claim 12 further comprising means for authenticating said media.

14. The system of claim 12 further comprising a network for communicating data between said first game machine and said winning display machine.

15. The system of claim 12 wherein said media is a printed receipt and including a receipt printer associated with said first gaming device.

16. The system of claim 12 wherein said winning display machine is configured to present a second game comprising said sensory feedback.

17. The system of claim 12 wherein said first game machine does not pay winnings for winning game results.

18. The system of claim 12 wherein said winning display machine is configured to award winnings for winning results.

19. The system of claim 12 including a server configured to store game results information.

20. A method of playing a game comprising:

accepting a wager at a first gaming machine;

displaying a wagering game at said first gaming machine;

if a result of said game is a losing outcome:

displaying game information indicating said losing outcome; and ending said game and permitting play of another game; and if said result of said game is a winning outcome:

displaying game information indicating said result is a winning outcome but not indicating a value of an award associated with said outcome;

associating information regarding said winning outcome with a media;

accepting said media at a winning display machine different than said first gaming machine; and utilizing said information associated with said media to display winning outcome information at said winning display machine, said winning outcome information comprising a value of said award associated with said winning outcome; and awarding said award at said winning display machine.

* * * * *